US005360104A

United States Patent [19]

Sutherland

[11] Patent Number: 5,360,104

[45] Date of Patent: Nov. 1, 1994

[54] WRAP-AROUND CARRIER WITH FLEXIBLE END PANELS

[75] Inventor: Robert L. Sutherland, Kennesaw, Ga.

[73] Assignee: Riverwood International Corporation, Atlanta, Ga.

[21] Appl. No.: 143,324

[22] Filed: Oct. 26, 1993

[51] Int. Cl.[5] ..... B65D 75/08

[52] U.S. Cl. ..... 206/147; 206/427

[58] Field of Search ..... 206/427, 429, 434, 435, 206/140, 147, 162, 170, 174; 229/40

[56] References Cited

U.S. PATENT DOCUMENTS

| | | | |
|---|---|---|---|
| 2,705,556 | 4/1955 | Ringler | 206/427 |
| 4,096,985 | 6/1978 | Wood | 229/40 |
| 4,216,861 | 8/1980 | Oliff | 206/427 |
| 4,941,624 | 7/1990 | Schuster | 206/427 X |
| 5,052,552 | 10/1991 | Maroszek | 206/174 |
| 5,060,792 | 10/1991 | Oliff | 206/140 |
| 5,195,676 | 3/1993 | Le Bras | 279/40 |

*Primary Examiner*—Bryon P. Gehman

[57] ABSTRACT

A wrap-around carrier with end panels. Folded gusset panels connecting the end panel flaps and the bottom panel are located between the bottoms of the packaged articles and the bottom panel, thereby locking the end panel flaps in closed position. Transverse and upwardly extending fold lines in the end panel flaps allow the end panel flaps to flex so as to better conform to the shape of adjacent articles.

20 Claims, 3 Drawing Sheets

WRAP-AROUND CARRIER WITH FLEXIBLE END PANELS

FIELD OF THE INVENTION

This invention relates to wrap-around carriers, and more particularly to wrap-around carriers having end panels capable of conforming to articles having irregularly shaped bottom portions.

BACKGROUND OF THE INVENTION

Wrap-around carriers are well known as a relatively inexpensive but effective means for packaging articles, requiring blanks of only minimum size which are capable of running on packaging machines at high speeds. A wrap-around carrier is typically formed by wrapping a carrier blank around a group of articles and securing the ends of the blank together at the bottom of the carrier. By tightly wrapping the articles and gripping the articles with the edges of heel openings in the side panels through which the heels or bottom portions of the articles protrude, the articles are contained in the carrier and prevented from falling out through the open ends. An example of such an arrangement is found in a wrap-around carrier containing beverage bottles.

While such measures have been successful in containing bottles of traditional design in their wrap-around carriers, new bottle designs do not always lend themselves to conventional treatment. The trend to larger beverage bottles makes it incumbent to employ carriers that are not only structurally capable of supporting heavier loads but are able to positively prevent outward movement of the end bottles. This becomes even more difficult when the bottle design is such that it no longer includes a conventionally shaped heel. A conventionally shaped heel is circular in cross section, so that the relationship between the bottle and the heel cutout remains the same regardless of which portion of the bottle is facing toward the cutout. The orientation of the bottles within the carrier at the time of packaging and during shipping is therefore not a consideration in designing the cutouts. A problem arises when the bottle heels have varying contours of irregular shape. One such type of beverage bottle is formed of plastic and has a decorative bottom portion of petaloid shape. These bottles have support feet which are regularly spaced from each other about the periphery of the bottle. The sides of the support feet as well as the lower surface of the feet terminate at a point near the center of the bottom of the bottle, which is slightly higher than the bottom support surfaces of the feet. Thus when one views the bottom of the bottle, as in a plan view, the appearance of the bottom face is petaloid in nature, with the center area appearing to form the center of a flower and the support feet the petals.

Since the heel portions of petaloid bottles are not uniform, being broken up by the spaced support feet, the normal rotation of the bottles as they are moved into place for packaging makes it impossible to predict the exact portion of the heel which will be presented to a cutout at the time the carrier wrap is applied. Further, even if it were possible to orient the bottles so that the cutouts are able to fit the precise shape of the heel design presented at the time of packaging, rotational movement of the bottles in the package during shipping would tend to misalign the heel portions with the cutouts, rendering the cutouts ineffective. Aggravating the problem is the fact that petaloid bottles are sometimes formed with four support feet and sometimes with five, which present different contours to the cutouts.

Another problem of conventional wrap-around carriers is the ease with which the end articles can be removed from the carrier in a store and purchased as a single item, thus destroying the integrity of the carrier. A further problem is the visibility of the product bar code on the end articles. This can lead to errors in calculating the bill since the bar code reader will charge only the price of a single article if it reads the code of an end article rather than the code printed on the carrier itself.

It would be desirable to be able to employ wrap-around carriers to package bottles and other articles whose design makes it difficult or impossible to be held in place by side panel cutouts, and to do so without danger of the articles sliding out the ends of the carrier. It would also be desirable to have a wrap-around carrier that covers the bar code on the end articles.

BRIEF SUMMARY OF THE INVENTION

The invention makes use of a wrap-around carrier which includes the basic arrangement of opposite side panels connected along fold lines to top and bottom panels. In addition, each side panel is foldably connected at its ends to an end panel flap and each bottom panel flap is foldably connected to a gusset panel. The gusset panels, which are also foldably connected to the end panel flaps, include an intermediate diagonal fold line about which the gusset panel is folded during formation of the carrier, resulting in portions of the folded gusset panels being located between the bottom panel and the bottoms of adjacent articles. The end panel flaps include a transverse fold line extending generally transversely of the height of the articles and an intermediate fold line extending from the transverse fold line to the upper edge of the end panel flap. These fold lines permit the end panels to flex outwardly in order to more closely follow the contour of adjacent articles in the package.

In a preferred arrangement, the end panel flaps include a cutout extending from the intersection of the transverse fold line and the intermediate fold line to the first fold line of the gusset panel. This creates spaced tabs or webs at the bottom of the end panel flaps which permit the separate end panel sections formed by the intermediate fold line to separately flex in response to outward pressure from the end articles in the package. A second intermediate fold line may be provided in the end panel flaps to permit the end panels to even more closely follow the contour of adjacent articles. This is accentuated in carriers where the fold lines connecting the end panel flaps to the side panels are more closely spaced apart at their upper ends than at their lower ends.

By holding the gusset panels in place between the articles and the bottom panel, the end panels to which the gusset panels are connected are locked against outward movement of the articles while still being able to flex when the opposed by a petaloid bottle foot or other noncontinuous surface of an article. The gusset panel design also causes the end panels to automatically set up when the gusset panels are folded. Adjacent end panel flaps may be provided with engaging locking edges to further hold the end panel flaps in place.

The invention may be employed in carriers used in packaging conventionally shaped bottles and other articles, but is especially useful when packaging articles that do not have a symmetrical continuous lower periphery, such as petaloid bottles. The end panels not only prevent outward movement of the end articles, but also conceal the bar code on the individual articles.

These and other features will readily be apparent from the more detailed description of the preferred embodiment of the invention which follows.

DETAILED DESCRIPTION OF THE PREFERRED EMBODIMENT

Figure 1:
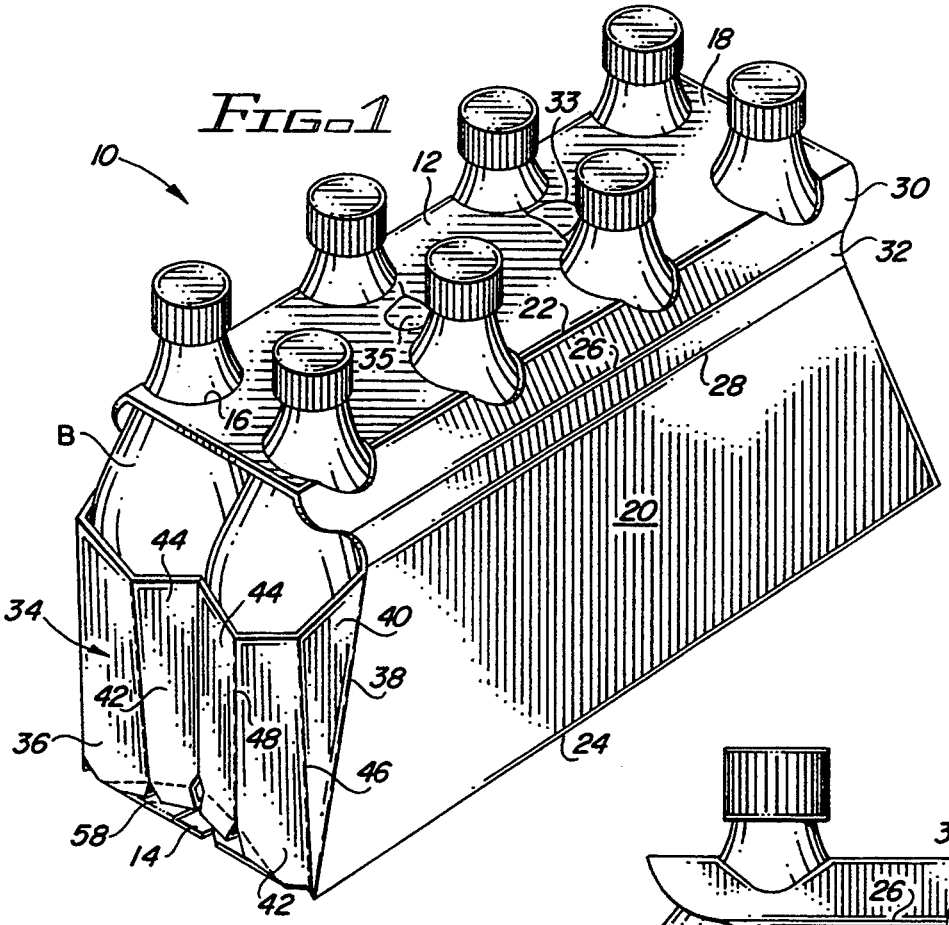
FIG. 1 is a pictorial view of the carrier of the invention.
Figure 2:
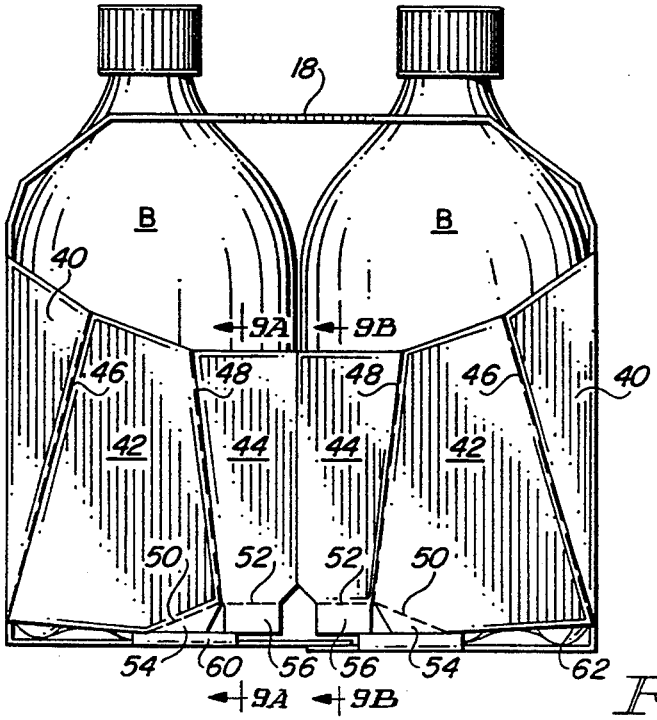
FIG. 2 is an end view of the carrier.
Figure 3:
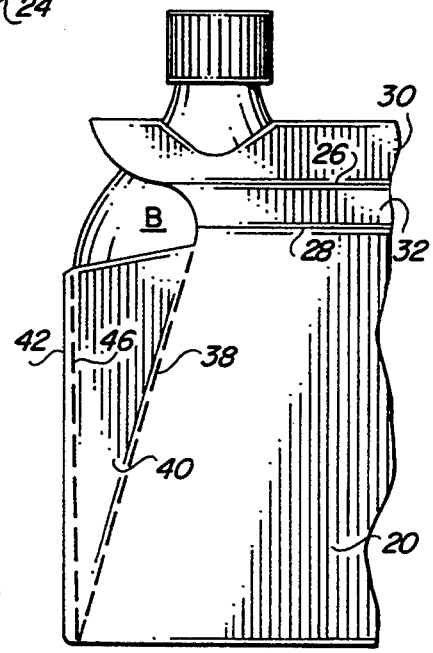
FIG. 3 is a partial side view of the carrier.

Referring to FIGS. 1, 2 and 3, the package 10 comprises a wrap-around carrier 12 containing eight beverage bottles B supported on bottom panel 14 and extending up through neck openings 16 in top panel 18. Side panels 20 are connected to the top panel along fold lines 22 and to the bottom panel along fold lines 24. A pair of spaced fold lines 26 and 28, which are parallel to and spaced a short distance from the fold lines 20, form short sloped panel sections 30 and 32 within the side panels 18. The sloped panel sections contact the tapered portions of the bottles in the transition area between the neck and barrel to hold the bottles securely in this area. The carrier also includes a pair of finger holes 33 covered with hinged tabs 35 for use in lifting the package.

End panels 34 are comprised of two identical flaps 36 connected to the side panels along fold lines 38. The fold lines 38 at the end of each side panel are angled toward each other, making the bottom panel fold lines 24 longer than the fold lines 28. Each flap is divided into three sections 40, 42 and 44, which are separated from adjacent flap sections by intermediate fold lines 46 and 48. The angled fold lines 38 and the intermediate fold lines 46 and 48 allow the end flap sections to follow the contour of the curved barrel portions of the bottles. In addition, as best illustrated in FIG. 2, transverse fold lines 50 and 52 in the flap sections 42 and 44, respectively, form spaced tabs or webs 54 and 56. The tabs 54 and 56 in turn are connected to gusset panels which are not visible in these views except for a portion 58, seen in FIG. 1, which is connected at a fold 60, seen in FIG. 2. The outer tabs 54 are also preferably spaced from the side panels by the lower edge 62 of the flap section 42, which extends to the intersection of the end flap fold lines 38 and 46, located a short distance above the bottom panel. The details of the gusset panel construction are shown more clearly in FIGS. 4 and 5, and their function is explained more fully later.

Figure 4:
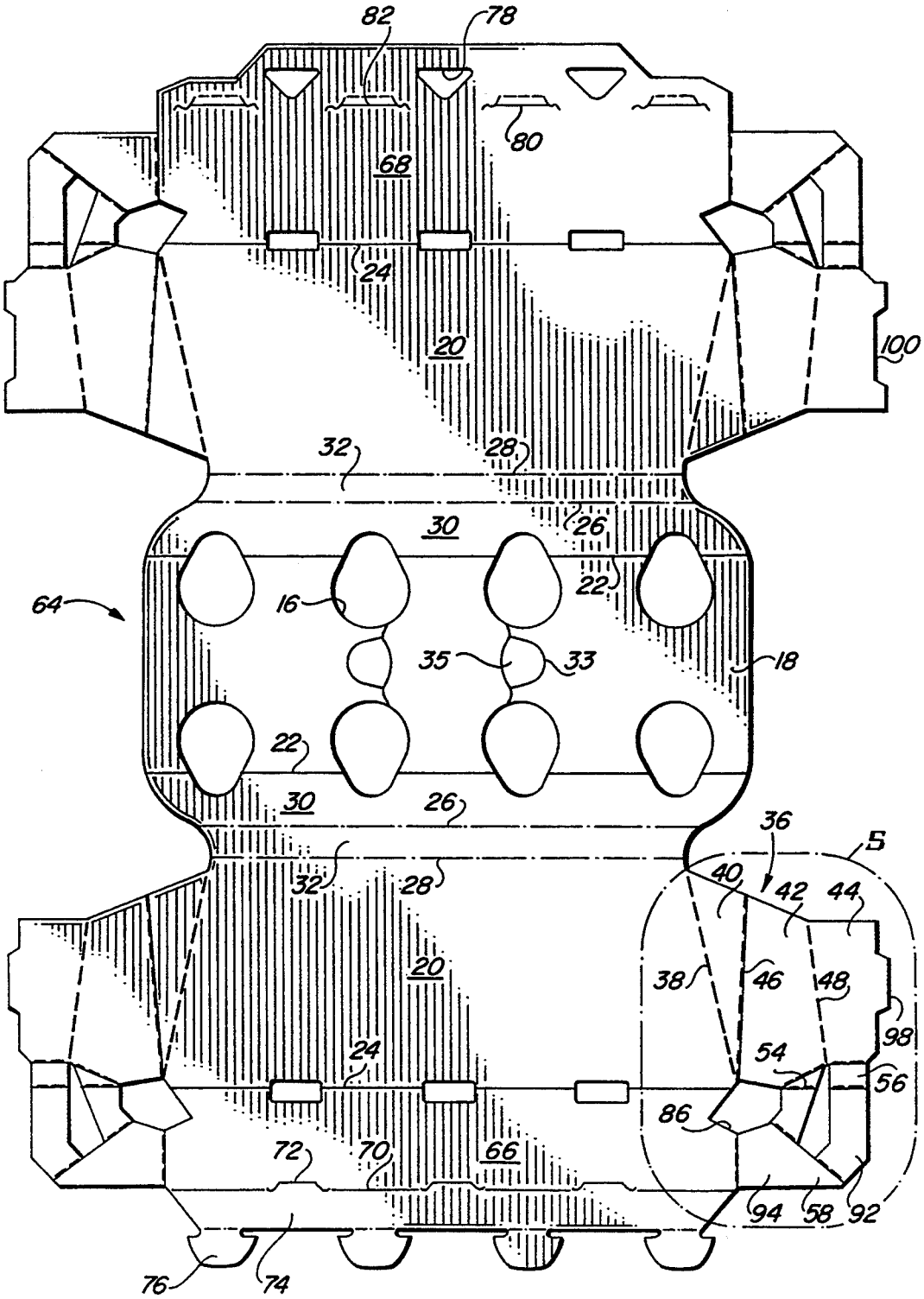
FIG. 4 is a plan view of a blank used to form the carrier.

Referring now to FIG. 4, wherein like reference numerals to those used in FIGS. 1, 2 and 3 denote like elements, a blank 64 capable of being fabricated into the carrier of FIG. 1 is comprised of a central top panel section 18 connected at opposite sides by the fold lines 22 to the sloped side panel sections 30. The openings 16 for receiving the necks of the bottles extend partially into the sloped side panel sections 30 to allow the sloped panels to conform closely to the shape of the bottles in the transition area between the neck and barrel.

The fold lines 24 connect the side panels to bottom panel flaps 66 and 68. The bottom panel flap 66 includes a fold line 70 which extends the full length of the flap and which is interrupted by primary male locking tabs 72. The portion 74 of the flap 66 lying outwardly of the fold line 70 constitutes a locking panel which includes secondary male locking tabs 76. The bottom panel flap 68 includes primary female locking edges 78 adapted to engage the primary male locking members 72 and slits 80 adapted to receive the secondary locking tabs 76. Tabs 82 are foldably connected to the bottom panel flap 68 a short distance outwardly of the slits 80 to facilitate entry of the locking tabs 76 into the slits. These various locking elements are illustrated to demonstrate a typical bottom panel locking arrangement suitable for use with the carrier of the invention, but it should be understood that any desired effective form of bottom panel locking means may be employed.

Figure 5:
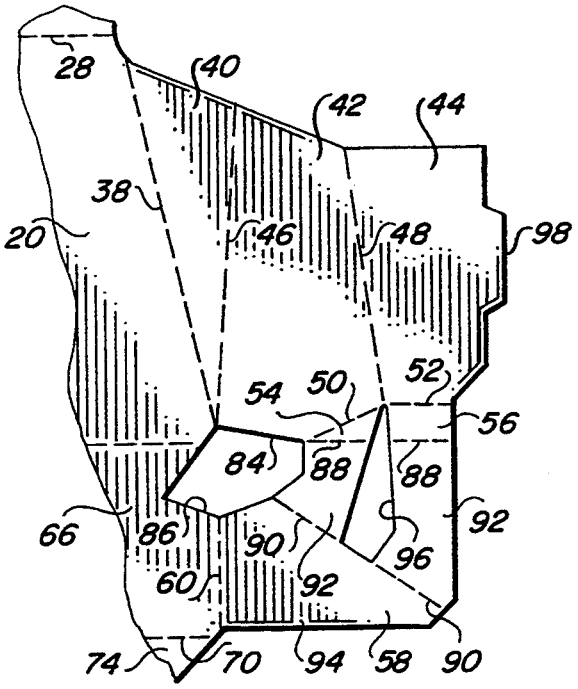
FIG. 5 is an enlarged partial plan view of the blank, showing the area within the oval 5 of FIG. 4.

Still referring to FIG. 4, and also at this time to FIG. 5, each end panel flap section 40 terminates at its lower end at the intersection of the fold lines 38 and 46. The end flap sections 44 terminate at the fold line 52, while the end flap sections 42 terminate along the combined lengths of the fold line 50 and the edge 84 of cutout 86. As previously stated, the tabs 54 and 56 are connected at one end to the fold lines 50 and 52. As illustrated, they are connected at their other end to the fold line 88, which is an extension of the fold line 24. Connected to the fold line 88 is the gusset panel 58, which is also connected by the fold line 60 to the bottom panel flaps 66 and 68. The fold lines 60 and 88, if extended, would intersect at the intersection of the fold lines 38 and 46. A diagonal fold line 90 divides the gusset panel 58 into a first portion or segment 92 and a second portion or segment 94, with the second gusset segment 68. The inner edges of the gusset panel portions 92 and 94, and portions of the bottom panel flaps terminate at the cutout 86, defining edges of the cutout. The cutout 86 facilitates the folding of the gusset panels and the adjacent flaps. Another cutout 96 in the first gusset panel segment 92 extends up to the intersection of the fold lines 48, 50 and 52, thereby separating the tabs 54 and 56. The function of the tabs 54 and 56 will be made clear in the following description of the folding operations.

Figure 7:
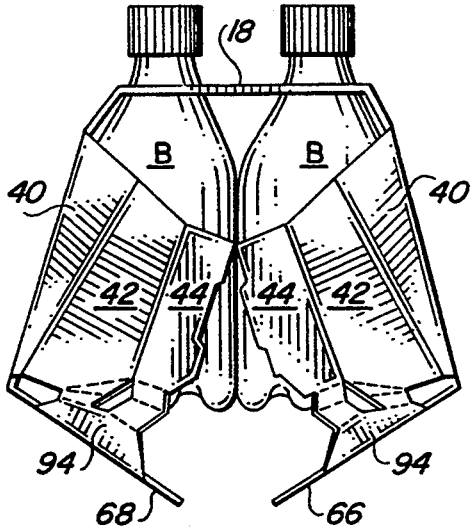
FIG. 7 is an end view similar to that of FIG. 6, but showing the blank in the process of being folded into bottom panel locking position.

To form a package of bottles, the bottles are grouped together as they are to be arranged in the package and the top panel section of the blank is placed on top of them, with the necks of the bottles extending through the bottle neck openings. The blank is first folded down about the top panel fold lines 22 to the initial interim position shown in FIG. 6, with the side and end panel sections, the gusset panels and the bottom panel sections remaining in the same planar relationship as in FIG. 4. The gusset panel segments 94 are then folded in about fold line 60 and held in place while the blank is folded about the fold lines 24 and the ends of the blank are moved toward each other into bottom panel locking position. The configuration of the blank in FIG. 7 illustrates the blank just prior to the bottom panel flaps reaching their final overlapping position. If this folding sequence takes place during movement through a packaging machine, the gusset panel segments 94 are engaged and moved by suitable packaging machine elements in order to fold the gusset panel into this position. Neither the packaging machine itself nor the folding elements of the machine have been shown since the various mechanical movements required in order to fold the panels of a carrier into place are well within the scope of one skilled in the packaging machine art. Referring back to FIGS. 4 and 5, when the gusset panel segments 94 are folded about fold line 60 to bring the segments 94 into face-to-face contact with the bottom panel flaps 66 and 68, the gusset panel segment 92 moves with it, folding down about the intermediate fold line 90. The interrupted fold line 88 connecting the gusset panel segment 92 and the end panel flap tabs 54 and 56 moves with the segment 92, causing the end panel flaps 36 to pivot about the fold lines 38. As this occurs, the end panel flap sections 42 and 44 also fold in about the fold lines 46 and 48 to tightly bind against the end articles in the package.

The next step in the formation of the package is to lock the bottom panel flaps together. The details of this phase of the operation have not been illustrated since the particular locking mechanism employed does not form part of the invention. It will be understood by those familiar with the art, however, that the outer flap portion or locking panel 74 of the bottom panel flap 66 is folded back about the fold line 70 and the primary male locking tabs 72 are engaged with the primary female locking edges 78 in bottom panel flap 68. The secondary male locking tabs 76 are then inserted through the slits 80 to complete the mechanical locking action, resulting in the package of FIG. 1.

Figure 8:
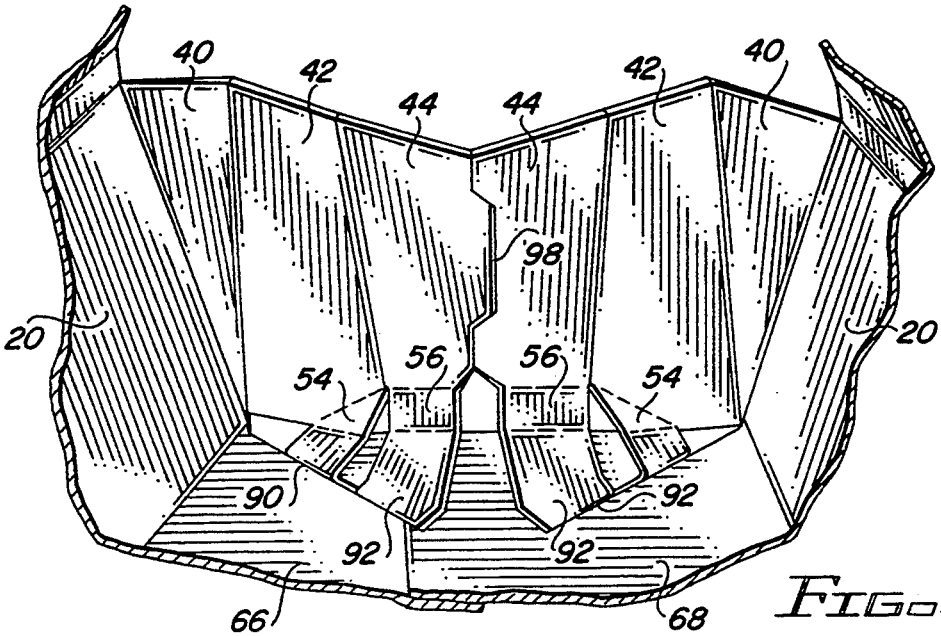
FIG. 8 is a partial inside view of the carrier, with the bottles being omitted for the sake of clarity.

When the bottom panel flaps are folded into position beneath the bottles, the folded gusset panel segments 92 and 94 are moved up against the bottoms of the bottles. The position of the folded gusset panels with respect to the bottom panel and with respect to the bottles is illustrated in FIG. 8. It can be seen that the bottoms of the end bottles or other articles in the package would rest on the gusset panels. Because the end panel flaps are connected to the gusset panels, the end panel flaps are thereby locked in place, enabling them to restrain outward movement of the bottles. While the width of the gusset panel segments is a matter of design preference, they must be wide enough to allow a significant area of the folded gusset panel to engage the bottom of a bottle without interfering with the locking of the bottom panel flaps.

Figure 6:
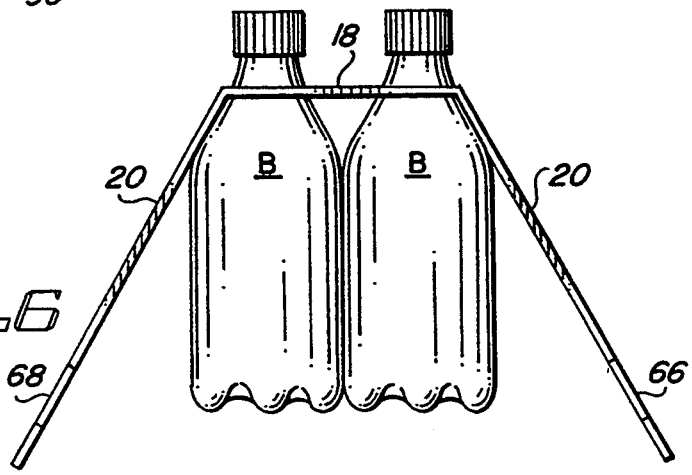
FIG. 6 is an end view of the blank in an initial stage of carrier formation after being placed over a group of bottles and initially folded.

The carrier as described thus far is of use in packaging and retaining articles such as conventionally shaped beverage bottles. In addition, the fold lines 50 and 52, and the tabs 54 and 56 formed by fold lines 50, 52 and 88, uniquely adapt the carrier to the packaging of bottles having irregularly shaped bottoms, such as the spaced legs of petaloid bottles. As illustrated in FIGS. 6 and 7, the petaloid legs of the bottle on the left are rotated from the angular position of the legs of the bottle on the right. Of course, the bottles may assume any position intermediate those shown since their orientation in the carrier is completely random. Thus, depending on the orientation of the end bottles, the legs of the bottles are capable of exerting outward pressure against any part of the lower portion of the end panel. It will be understood from the drawing, particularly FIGS. 1, 2 and 8, that when outward pressure by one or more of the spaced legs of a petaloid bottle against the end panel occurs, the fold lines 50 and 52 enable the end panel to flex outwardly.

The end panels are able to closely follow the contour of adjacent bottles or other curved articles as a result of each end flap being comprised of three segments and the two connecting fold lines 46 and 48. The transverse fold lines 50 and 52 further permit the end panels to closely follow the contour of the bottom portion of petaloid bottles, or other types of articles having an irregularly shaped lower portion. The space between the tabs 54 and 56, formed by the upper end portion of the cutout 96, allows separate flexing of the tabs and permits the tab fold lines 50 and 52 to be nonaligned. Without the spaces, the resulting larger tabs would have to be connected to the end panel sections 42 and 44 along a single long fold line in order to enable the larger tabs and their end panel sections to flex, which would restrict the degree of flexure and the ability of the end panels to follow the lower contour of the articles. Although the spaces between the tabs 54 and 56 are formed by the end portion only of the cutout 96 in the gusset panels, it is preferred that the cutout extend as shown through the entire gusset panel segment 92 to the diagonal fold line 90. This arrangement permits slight shifting of the legs of the gusset panel segment on either side of the cutout 96 to occur as pressure is exerted on the tabs 54 and 56, thereby making it easier for the end panel to make necessary initial adjustments as the end panels are tightened into place. The larger cutout also simplifies the blank production operation.

Referring back to FIG. 4, the end panel sections 48 at the lower end of the blank include a locking tab 98, while the end panel sections 48 at the upper end of the blank include a recess 100. When the end panels are folded into place the locking tab 98 fits into the recess 100 to mechanically hold the end edges of the end panel flaps in place. This is illustrated best in FIG. 8. When forming the package, it is preferred not to interlock the end panel flaps until the bottles are all set in place. This is because the bottles tend to move out slightly when wrapped, and if the end panels were prematurely locked in place this desirable outward movement which settles the bottles into a final secure position would be prevented. An added advantage of the lock is that it aligns the end panels in a predetermined position, making it possible to align graphics on the end panel flaps. Although the provision of a lock is preferred, it is not essential to the basic functioning of the carrier wrap, since the primary force holding the end panels in place results from the folded gusset panels and the weight of the bottles holding them in place. If it decided not to include the lock, it is preferred to leave a slight gap between the adjacent end panel edges to avoid having a critical graphic match at this point.

It will be appreciated that the invention not only provides a carrier with end panel flaps for holding petaloid bottles or other irregularly shaped articles in place, but employs a design which automatically closes the end panel flaps when the bottom panel flaps are moved into position to be locked together. The invention thus provides end panel restraints on a wrap-around carrier, which normally is not provided with end panels. Although described in connection with an eight-bottle carrier, the invention can obviously be employed in carriers designed to carry fewer or more articles.

It should now be apparent that the invention is not necessarily limited to all the specific details described in connection with the preferred embodiment, but that changes to certain features of the preferred embodiment which do not alter the overall basic function and concept of the invention may be made without departing from the spirit and scope of the invention as defined in the appended claims.

What is claimed is:

1. A package comprised of a wrap-around carrier containing a plurality of articles, comprising:

opposite side panels, each side panel being connected along an upper fold line to a top panel and along a lower fold line to a bottom panel flap, the bottom panel flaps being connected to each other to form the bottom panel of the carrier;

each side panel having spaced apart end portions and being connected along a fold line at each end portion thereof to an end panel flap;

each end panel flap having an upper edge and a lower edge;

a gusset panel connected along a first fold line to the lower edge of each end panel flap and along a second fold line to an adjacent end edge of an associated bottom panel flap;

each gusset panel having an intermediate diagonal fold line about which the gusset panel is folded, portions of the gusset panel being positioned between the bottom panel and the bottoms of adjacent articles in said carrier; and each end panel flap including a transverse fold line extending generally transversely of the height of the articles and an intermediate fold line extending from the transverse fold line to the upper edge of the end panel flap, said transverse and intermediate fold lines permitting the end panels to flex outwardly in order to more closely follow the contour of adjacent articles in the package.

2. A package as defined in claim 1, wherein each end panel flap includes a cutout extending from the intersection of the transverse fold line and the intermediate fold line to the first fold line of the gusset panel.

3. A package as defined in claim 2, wherein the cutout extends past said first fold line of the gusset panel to the diagonal fold line of the gusset panel.

4. A package as defined in claim 2, wherein the transverse fold line is comprised of converging fold line segments which meet at the intersection of the transverse fold line and the intermediate fold line.

5. A package as defined in claim 4, wherein each end panel flap includes a second intermediate fold line extending from the upper edge thereof at an angle to the fold line connecting the end panel flaps to the side panels.

6. A package as defined in claim 5, wherein the second intermediate fold line intersects the fold line connecting the end panel flaps to the side panels at substantially the intersection of the fold line connecting the end panel flaps to the side panels and the lower fold line of the side panel.

7. A package as defined in claim 1, wherein the fold lines connecting the end panel flaps to an associated side panel are more closely spaced apart at their upper ends than at their lower ends, and the fold lines connecting the end panel flaps to the side panels terminate below the fold line connecting the side panel to the top panel.

8. A package as defined in claim 1, wherein each gusset panel includes an opening defined by an interior gusset panel edge, an edge of the associated end panel flap and an edge of the associated bottom panel flap.

9. A package as defined in claim 1, wherein the articles comprise beverage bottles having cylindrical main body portions and lower portions comprised of spaced feet, the transverse fold lines of the end panels being located adjacent the feet.

10. A package as defined in claim 9, wherein the top panel includes bottle neck openings through which the necks of the bottles extend and wherein the side panels are comprised of a main side panel body portion and an upper sloped portion connected thereto along a fold line.

11. A package as defined in claim 1, wherein adjacent end panel flaps have engaging locking edges to further hold the end panel flaps in place.

12. A blank for forming a wrap-around carrier for packaging a plurality of articles, comprising:

a top panel section connected along fold lines at a side panel section;

each side panel section having spaced apart end portions and being connected along a lower fold line to a bottom panel flap, the bottom panel flaps being adapted to be connected to each other to form the bottom panel of a carrier formed from the blank;

each side panel section being connected along a fold line at each end thereof to an end panel flap;

each end panel flap being connected along a first fold line at a lower end edge thereof to a gusset panel;

each gusset panel being connected along a second fold line to an adjacent end edge of an associated bottom panel flap;

each gusset panel including an intermediate diagonal fold line about which the gusset panel is folded in a carrier formed from the blank so that a portion of the folded gusset panel lies between the bottom panel of the carrier and the bottom of an adjacent article within the carrier;

each end panel flap including a transverse fold line extending generally transversely of the end panel flap and an intermediate fold line extending upwardly from the transverse fold line, said transverse and intermediate fold lines permitting the end panels of a carrier formed from the blank to flex outwardly in order to more closely follow the contour of adjacent articles in the carrier.

13. A blank as defined in claim 12, wherein each end panel flap includes a cutout extending from the intersection of the transverse fold line and the intermediate fold line to said first fold line.

14. A blank as defined in claim 13, wherein the cutout extends past said first fold line of the gusset panel to the diagonal fold line of the gusset panel.

15. A blank as defined in claim 13, wherein the transverse fold line is comprised of converging segments which meet at the intersection of the transverse fold line and the intermediate fold line.

16. A blank as defined in claim 15, wherein each end panel flap includes a second intermediate fold line extending upwardly from the transverse fold line at an angle to the fold line connecting the end panel flaps to the side panel sections.

17. A blank as defined in claim 16, wherein the second intermediate fold line intersects the fold line connecting the end panel flaps to the side panel sections at substantially the intersection of the latter fold line and the fold line connecting the side panel section to the bottom panel section.

18. A blank as defined in claim 12, wherein the fold lines connecting the end panel flaps to an associated side panel section are more closely spaced apart at their upper ends than at their lower ends.

19. A blank as defined in claim 12, wherein each gusset panel includes an opening defined by an interior gusset panel edge, an edge of the associated end panel flap and an edge of the associated bottom panel flap.

20. A blank as defined in claim 12, wherein the end panel flaps at one end of the blank include locking edges which engage with locking edges on the end panel flaps at the opposite end of the blank in a carrier formed from the blank.

* * * * *